US011640815B2

(12) United States Patent
Vorobyev

(10) Patent No.: US 11,640,815 B2
(45) **Date of Patent: *May 2, 2023**

(54) LANE- AND RHYTHM-BASED MELODY GENERATION SYSTEM

(71) Applicant: MIXED IN KEY LLC, Miami, FL (US)

(72) Inventor: Yakov Vorobyev, Miami, FL (US)

(73) Assignee: MIXED IN KEY LLC, Miami, FL (US)

( * ) Notice: Subject to any disclaimer, the term of this patent is extended or adjusted under 35 U.S.C. 154(b) by 93 days.

This patent is subject to a terminal disclaimer.

(21) Appl. No.: 17/137,014

(22) Filed: Dec. 29, 2020

(65) Prior Publication Data

US 2021/0327397 A1 Oct. 21, 2021

Related U.S. Application Data

(63) Continuation of application No. 16/505,197, filed on Jul. 8, 2019, now Pat. No. 10,896,663.

(60) Provisional application No. 62/822,450, filed on Mar. 22, 2019.

(51) Int. Cl.
*G10H 1/00* (2006.01)
*G10H 1/40* (2006.01)

(52) U.S. Cl.
CPC ..... *G10H 1/0025* (2013.01); *G10H 1/40* (2013.01); *G10H 2210/066* (2013.01); *G10H 2210/331* (2013.01); *G10H 2220/091* (2013.01)

(58) Field of Classification Search
CPC .. G10H 1/0025; G10H 1/40; G10H 2210/066; G10H 2210/331; G10H 2220/091
USPC ..... 84/609
See application file for complete search history.

(56) References Cited

U.S. PATENT DOCUMENTS 4,926,737 A * 5/1990 Minamitaka ..... G10H 1/0025 84/DIG. 12
5,225,618 A * 7/1993 Wadhams ..... G09B 15/00 84/645
8,704,071 B1 * 4/2014 Wolfram ..... G10H 1/0025 84/622

(Continued)

FOREIGN PATENT DOCUMENTS

WO WO-2007091938 A1 * 8/2007 ..... G10H 1/0025

OTHER PUBLICATIONS

Cubase "Chord Track Inspector" Jan. 2017 https://steinberg.help/cubase_pro_artist/v9.5/en/cubase_nuendo/topics/tracks_about/tracks_about_chord_track_inspector_r.html.

(Continued)

*Primary Examiner* — Christina M Schreiber
(74) *Attorney, Agent, or Firm* — Oblon, McClelland, Maier & Neustadt, L.L.P.

(57) ABSTRACT

To generate a melody, one or more machine-readable constraints are accepted from a user through a user interface. The constraints include rhythm constraints and pitch constraints. A sequence of musical elements is generated based on the constraints, each of the musical elements specifying, in machine-readable data, a musical pitch or silence and a duration of the musical pitch or silence. The pitch constraints prescribe pitches in the sequence of musical elements and the rhythm constraints prescribe rhythm of the sequence of musical elements. The sequence of musical elements is rendered in human-perceivable form as a melody.

20 Claims, 9 Drawing Sheets

(56) References Cited

U.S. PATENT DOCUMENTS

| | | | | |
|---|---|---|---|---|
| 9,165,543 | B1 * | 10/2015 | Vorobyev | G10H 1/0025 |
| 10,896,663 | B2 * | 1/2021 | Vorobyev | G10H 1/40 |
| 2004/0114769 | A1 * | 6/2004 | Little | H04R 5/04 381/71.11 |
| 2009/0025540 | A1 * | 1/2009 | Hillborg | G10H 1/0025 84/609 |
| 2010/0050854 | A1 * | 3/2010 | Huet | G10H 1/0025 84/611 |
| 2012/0031257 | A1 * | 2/2012 | Saino | G10H 5/005 84/622 |
| 2012/0297958 | A1 * | 11/2012 | Rassool | G10H 1/0025 84/609 |
| 2012/0297959 | A1 * | 11/2012 | Serletic | G09B 15/04 84/626 |
| 2013/0290818 | A1 * | 10/2013 | Arrasvuori | H04N 21/4383 715/201 |
| 2014/0053710 | A1 * | 2/2014 | Serletic, II | G09B 15/04 84/609 |
| 2014/0140536 | A1 * | 5/2014 | Serletic, II | G06F 3/0481 381/98 |
| 2017/0092247 | A1 * | 3/2017 | Silverstein | G06N 20/00 |
| 2019/0237051 | A1 * | 8/2019 | Silverstein | G10H 1/368 |
| 2019/0378482 | A1 * | 12/2019 | Vorobyev | G10H 1/38 |
| 2020/0302902 | A1 * | 9/2020 | Vorobyev | G10H 1/0025 |
| 2021/0327397 | A1 * | 10/2021 | Vorobyev | G10H 1/0025 |

OTHER PUBLICATIONS

Cubase Elements Video "The Chord Track and Chord Pads, Getting Started with Cubase Elements 10" Dec. 19, 2018 https://www.youtube.com/watch?v=tCAzECMjQOg.

Ben Rogerson, "Steinberg Cubase 7 announced: new features revealed" Nov. 14, 2012 https://www.musicradar.com/news/tech/steinberg-cubase-7-announced-new-features-revealed-566921.

Cubase 7 Promo Video, "More musical than ever" Nov. 13, 2012 https://www.youtube.com/watch?v=7OG5Q6goEVM.

* cited by examiner

LANE- AND RHYTHM-BASED MELODY GENERATION SYSTEM

CROSS-REFERENCE TO RELATED APPLICATION(S)

This application is a continuation of U.S. application Ser. No. 16/505,197, filed Jul. 8, 2019, which claims priority under 35 U.S.C. § 119(e) from U.S. Provisional Patent Application No. 62/822,450 entitled "Lane- and Rhythm-based Melody Generation System," filed Mar. 22, 2019, the entire content of each of which is incorporated herein by reference. Furthermore, U.S. Design patent application Ser. No. 29/686,452 entitled "Display Screen or Portion Thereof with Graphical User Interface" is also incorporated herein by reference in its entirety.

BACKGROUND

At its most basic, a melody is a combination of pitch and rhythm that is perceived as a single unit (has a beginning and an end). A melody manifests itself as a succession of tones and periods of silence that engages the mechanisms of human perception and consequently recognized by a listener as a distinct musical entity. Ultimately, it is human perception of the listener, with all of the psychosocial implications thereof, that distinguishes "good" melodies from the "bad." Clearly, the question of what musical qualities make a good melody is highly subjective. Nevertheless, the search for pleasant, catchy melodies is an ongoing endeavor in the music industry.

Musicians know melody as the "hook" of the song. It is the part of a music piece that is usually performed by an instrument such as a human voice, a synthesizer, a piano, or a guitar. Melody differs from chords in the number of notes played at once. Melodies typically have one note playing at a time, while chords have two or more notes playing at a time.

Musicians most desirably want to create songs that contain multiple instruments playing at the same time. Typical combinations include voice, guitar, piano, drums, bass, synthesizer/keys, and many more. While many musicians know how to play their favorite instruments, fewer people know how to compose and write music using every possible type of instrument. For example, a drummer may not be familiar with how to write a piano melody.

A common problem facing musicians is how to write melodies that complement chords. Indeed, many submissions to a widely-public music contest all shared a similar trait: the "hook" of the song, which is expected to be the most memorable part, was not memorable enough in many submissions. It was observed that many musicians struggled to write a hook, but did not struggle with writing chords or beats.

In most music genres, the same beat can be recycled across thousands of songs. For example, a typical rock beat can be heard in lots of successful songs from the 1990s, and a typical house music beat can be heard as the foundation of nearly every house music song released in the last 20 years. Thus, beats are the least unique and the least difficult elements of each song to write. Chords are the second easiest, because there are only seven possible common chords for each key/scale combination and there are 24 common key/scale combinations that are used in today's music. There are other possibilities for chords, but they can generally be considered extensions of the canonic seven chords for each key/scale combination.

Melodies tend to be the musical part where musicians can differentiate themselves. The top musicians of our time are known for having great melodies. The definition of a "great melody" varies, but the overall observation is that a great melody fits the overall feeling of the song and creates a catchy memory. Good melodies often provide musical storytelling, tension and resolution, and some repetition.

SUMMARY

To generate a melody, one or more machine-readable constraints are accepted from a user through a user interface. The constraints include rhythm constraints and pitch constraints. A sequence of musical elements is generated based on the constraints, each of the musical elements specifying, in machine-readable data, a musical pitch or silence and a duration of the musical pitch or silence. The pitch constraints prescribe pitches in the sequence of musical elements and the rhythm constraints prescribe rhythm of the sequence of musical elements. The sequence of musical elements is rendered in human-perceivable form as a melody.

DETAILED DESCRIPTION

Figure 1:
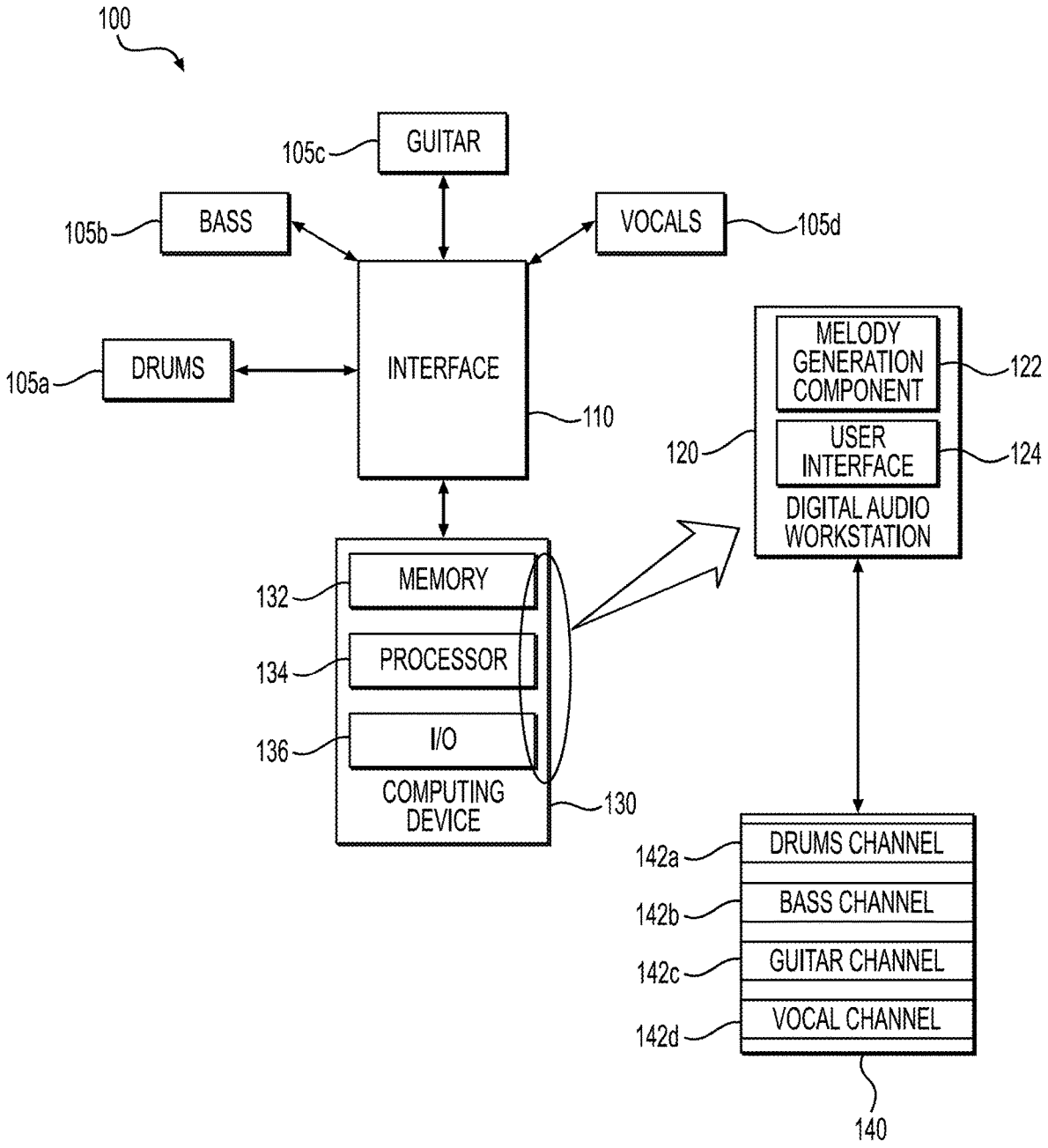
FIG. 1 is a schematic block diagram of an example environment in which the present invention can be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments. Particular quality or fitness of the examples indicated herein as exemplary is neither intended nor should be inferred.

Prior to discussing specific embodiments, it is believed beneficial to define/explain certain terms that are used throughout this disclosure.

Pitch refers to the perceived quality of sound that can be ordered on a scale of "higher" or "lower." In machine representations of music, pitch values may be assigned to variables in data structures representing individual notes.

Rhythm refers to the perceived timing of musical sounds and silences. Rhythm may be carried in a machine through the sequencing of musical elements, machine-readable data structures that associate sound or silence with a duration of that sound or silence.

A musical event is an occurrence in time of a perceived difference in a musical quality (change of pitch, silence/sound transitions).

Notes refer to a specification of sound, specifically a specification of pitch (such as note C, or note E-flat) and the duration of that pitch.

Rests refer to a specification of silence over a defined duration.

Musical space refers to a mapping of musical sounds and silences (notes and rests) onto coordinates specified by units of rhythm and units of pitch. Musical spaces may be represented in a machine by, for example, a Musical Instrument Digital Interface (MIDI) canvas, which, as used herein is a human-machine interface component by which MIDI data are created, edited and destroyed following a canvas metaphor for input/output.

A constraint is a conditioning on the selection of a musical element for the melody. A composer may constrain certain features of rhythm and pitch across a sequence of musical elements to define the melody, as is exemplified below.

Chords refer to multiple notes played simultaneously in harmony, known to musicians as the "vibe/emotion" of the song. For example, the C note, the E note, and the G note being played together would traditionally form the C Major chord. Chords are standard, and are known to musicians as a specific combination of different notes.

A lane is a pitch index into a set of pitches from which pitches are selected for notes of the melody. For example, a lane 1 may be associated with a root pitch, lane 2 may be associated with the root+1 pitch in scale of the song, and so on. Once a key/scale has been specified, each lane represents a pitch of that scale. In different scales, the same lane may represent different pitches, with the key/scale selection defining what pitch is assigned to a particular lane.

Lanes can also be built based on chords. A follow chords mechanism may be enabled for lanes, in which case each chord results in the re-numbering and re-selection of the notes used for the lanes. Lane 1 becomes the root note of the chord, not the overall scale. Lane 2 becomes the second note of the chord, lane 3 becomes the third note of the chord, and so on, for all lanes implemented.

Chord rhythm refers to the rhythm played by the chords only.

Melody rhythm refers to the rhythm played by the melody, including the rests between the melody notes.

A canvas grid refers to a standardized division of the MIDI canvas to show the location of each beat. A wide grid may show a vertical line on the canvas for every beat. A narrow grid may show a vertical line for every 1/16th division of one beat. Grids are typically adjustable by the user, and provide the user with flexibility to place notes in musical space and quantize them to the grid.

Quantizing refers to aligning each beat in a rhythmic pattern to the nearest beat of a given resolution (eighth note, sixteenth note, etc.), or to adjust the frequency or pitch of a note to the nearest perfect tone in a given musical scale. When a note is "quantized", it starts on a gridline of the canvas grid. If the note is not quantized, it floats in the space between gridlines.

A note repetition is a musical transition in rhythm only, where the pitch remains constant between adjacent notes.

A step is a musical transition from a note characterized by a first pitch to another note characterized by a second pitch that is adjacent to the first pitch in a musical scale of chord.

A leap is a musical transition that avoids adjacent pitches. The magnitude of the leap, i.e., how many adjacent notes are skipped in embodiments of the invention, is a user-selectable parameter or may be chosen algorithmically by machine operations.

A shape is a series of musical transitions that form a musical pattern. A shape may include an ascending pattern of notes, a descending pattern of notes, an up-down-up pattern of notes, a down-up-down pattern of notes, etc.

Embodiments of the present invention assist musicians in composing melodies that tie several instruments together and thus make a more cohesive music recording. In music speak, musicians often refer to creating music based on the "feel", or "what feels right" for that moment in the song. A technique is described herein for generating music based on the musician's desired "feel" that they get to control through a user interface of invention embodiments. The outcome is a cohesive, pleasant musical composition that may contain multiple instruments or layers of music, all playing in tandem with each other at the same time without clashing with each other.

FIG. 1 is a schematic block diagram of an example environment 100 in which the present invention can be embodied. As illustrated in the figure, computer resources of a computing device 130, e.g., memory 132, processor 134 and input/output component (I/O) 136, may be utilized to implement a digital audio workstation (DAW) 120. A DAW is an electronic device or application software used for recording, editing and producing audio files. In certain embodiments, the audio files are compliant with a protocol implemented by an interface 110, which may be MIDI. MIDI is a technical standard that describes a communications protocol, digital interface, and electrical connectors that connect a wide variety of electronic musical instruments, computers, and related audio devices for playing, editing and recording music. Through such an interface, musical data 140 may be conveyed to DAW 120 from, for example, drums 105*a*, bass 105*b*, guitar 105*c* and vocals 105*d*, representatively referred to herein instrument device(s) 105. As used herein, musical data are machine-readable entities that describe musical features. For purposes of explanation and not limitation, musical data 140 for different instrument devices 105 are carried in separate, selectable channels, e.g., a drums channel 142*a*, a bass channel 142*b*, a guitar channel 142*c* and vocal channel 142*d*. Of course, musical data of other instrument devices may be implemented as well.

Melody generation component 122 may execute in the operating environment of DAW 120, such as by way of a plugin. Indeed, embodiments of the invention may avail themselves of the plugin infrastructure described in U.S. patent application Ser. No. 15/929,065 entitled "Apparatus, Method and Computer-readable Medium for Generating Musical Pieces," the entire disclosure of which is incorporated herein by reference. However, it is to be understood that the present invention can be practiced separately from the DAW environment, as skilled artisans will appreciate upon review of this disclosure.

As illustrated in FIG. 1, DAW 120 may include a user interface 124, such as a graphical user interface, through which a user may interact with DAW 120 and compose music.

Figure 2:
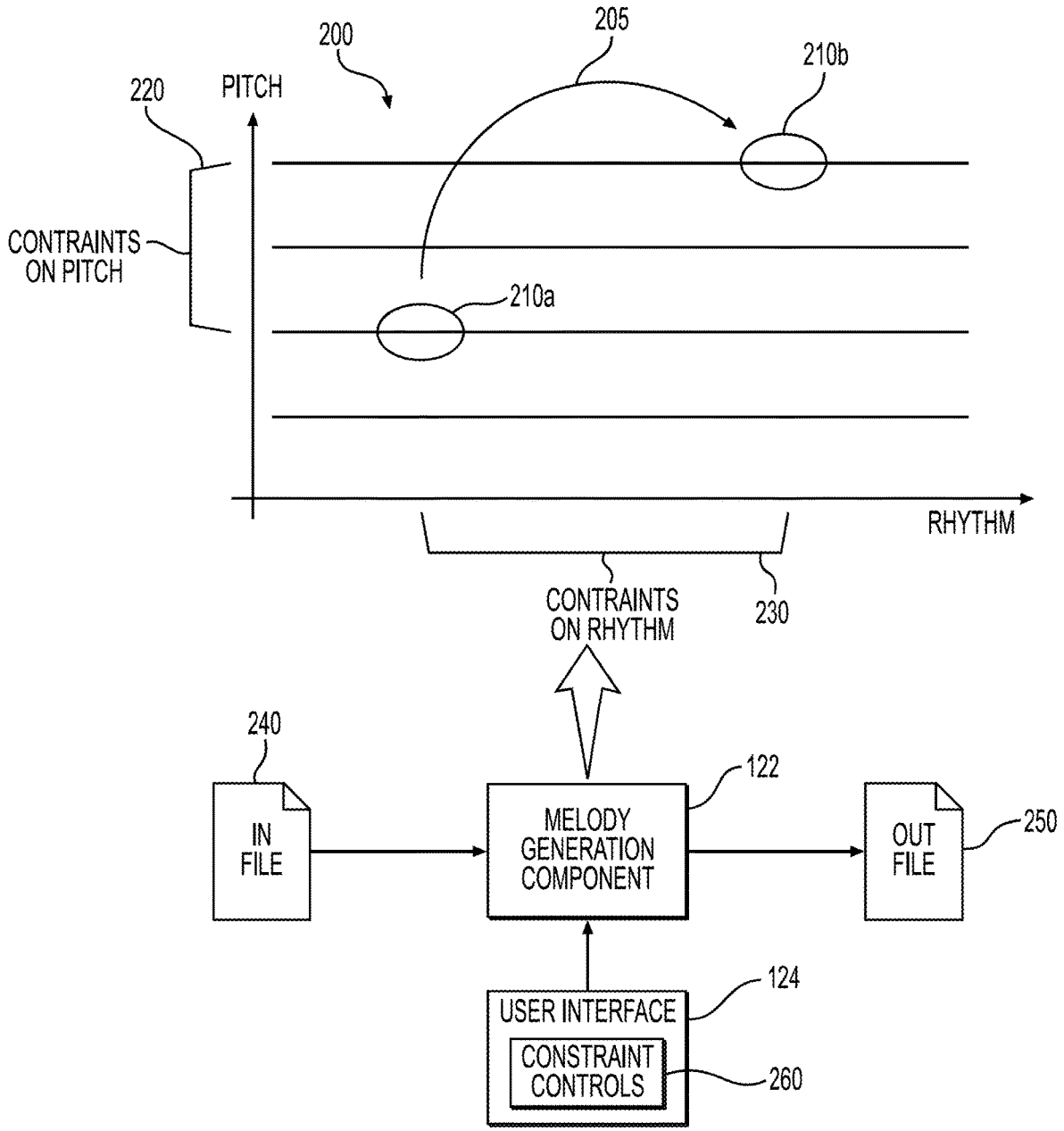
FIG. 2 is a conceptual block diagram by which principles of the present invention can be explained.

FIG. 2 is a conceptual block diagram by which principles of the present invention can be explained. A musical element, which is a data structure that describes musical characteristics in a machine, can be considered as located in musical space 200 at coordinates therein corresponding to a specific pitch and specific rhythmic timing (beat or fraction of a beat). A melody may be expressed as a trajectory through musical space 200, with musical elements of the melody being rendered aurally, such as through a speaker, and/or visually, such as through the user interface of a DAW, in a temporal sequence. Embodiments of the present invention seek to build such a trajectory by enforcing user-specified constraints on what musical elements are used in the melody and where such musical elements are placed in musical space 200. Such constraints are representatively illustrated in FIG. 2 at constraints on pitch 220 and constraints on rhythm 230 and set bounds on a musical transition 205 from a musical element 210*a* to a musical element 210*b*. The constraints determine what musical elements (notes and rests) are used in the melody and where those musical elements are placed in musical space 200. Such placement may be established by melody generation component 122 in accordance with constraints specified by a user through constraint controls 260. In certain embodiments of the invention, constraints on pitch 220 are specified independently of constraints on rhythm 230.

As illustrated in the figure, melody generation component 122 may be provided an input file 240 and may generate or otherwise produce an output file 250. Each of input file 240 and output file 250 may comprise musical data, such as musical data 140 described with reference to FIG. 1. In certain embodiments, such musical data conforms to a standard such as MIDI and can be utilized by a machine, such as a MIDI-compliant electronic instrument, to produce human-perceivable music. However, it is to be understood that the present invention is not limited to particular data formats in which musical data are conveyed, as skilled artisans will appreciate upon review of this disclosure.

The specification of a key/scale may establish the set of pitches that are represented in music space 200. Zero or more lanes may be specified that allow the composer control over what pitches appear in the final output of a new melody. The lanes may be considered constraints on inclusion of the corresponding note into the melody. Zero or more sources may be specified to analyze for input to analyze their rhythms and pitch structure. Such sources include, but are not limited to other melodies, chords, beats, or other musical elements. These sources may be represented in input file 240.

Musical elements include notes and their respective durations in terms of rhythm, and rests and their respective durations in terms of rhythm. The duration of a rest may be specified in the same way as the duration of notes is specified. It is to be understood that the representation of musical elements in a musical space, such as musical space 200, and indeed the representation of musical space 200 itself, may take different forms. For example, musical staff notation may be used in embodiments of the invention, although the "piano roll" notation may be more convenient for composers who are less literate in staff notation. Indeed, musical space 200 may be represented in a grid on a user interface that allows composers to draw, move, elongate/shorten and delete musical elements thereon. Such a user interface is a MIDI canvas, which, as used herein is a human-machine interface component by which MIDI data are created, edited and destroyed following a canvas metaphor for input/output.

On a piano, the lowest pitch is on the left side of the piano and the highest pitch is on the right side of the piano. For purposes of description and not limitation, pitch is lower in musical space 200 the closer a musical element is placed relative to the rhythm axis. Certain embodiments implement 88 pitches to correspond to the 88 keys of a conventional piano, but this range can be sized based on need. For example, a musical space, such as musical space 200, may be defined by seven (7) different pitches of a musical scale that can be selected by a user. When so implemented, musical space 200 is discretized to the extent that placement of musical elements therein is restricted to align on a certain fraction of a beat (as defined by a number of timing clock events) and on a certain pitch. It is to be understood, however, that in certain embodiments, such quantization can be overridden by the composer, particularly when composing music for a musical instrument that can produce arbitrary tones. Quantized notes have a more robotic feeling, while non-quantized notes have a more human, less organized feeling.

Figure 3:
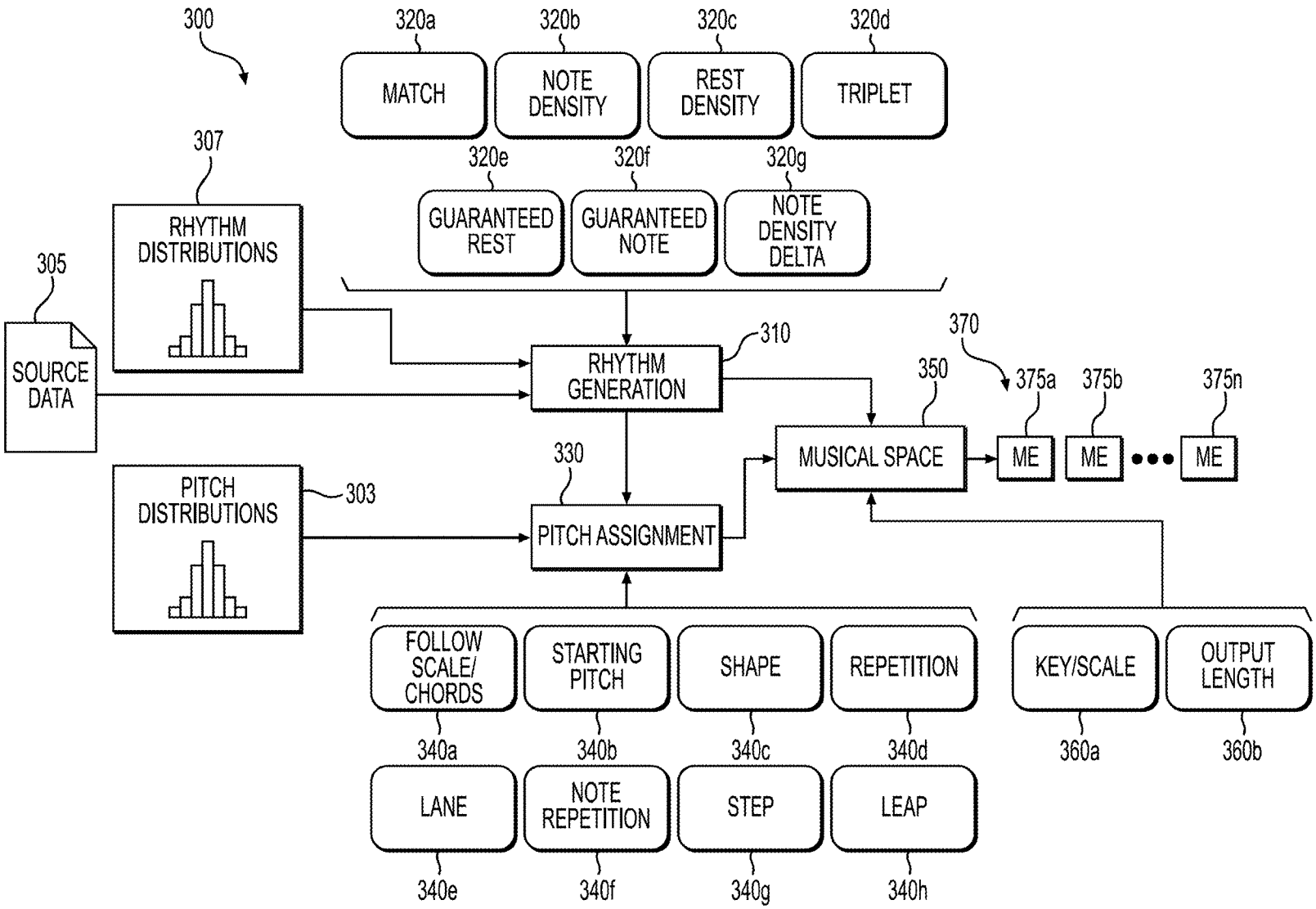
FIG. 3 is a schematic block diagram of an exemplary melody generation component 300 by which the present invention can be embodied.

FIG. 3 is a schematic block diagram of an exemplary melody generation component 300 by which the present invention can be embodied. As illustrated in the figure, melody generation component 300 may be viewed as comprising two (2) processing units—rhythm generation component 310 and pitch assignment component 330—that establish the nature of the melody being generated. The generated melody data, illustrated at melody data 370, may be stored in an association (data structures associated one with another through a specific sequence, for example) defining a musical trajectory through a musical space 350, by which the durations of the melody's musical elements, the relative timings of musical elements, the relative pitches of notes, etc., are specified. Musical space 350 may be realized as a MIDI canvas in which musical elements are assigned characteristics in accordance with their location in musical space 350 as specified by pitch and rhythm coordinates. It is to be understood, however, that melody data 370 may be generated and stored as a sequence of musical elements 375*a*-375*n*, representatively referred to herein as musical elements 375, containing the assigned characteristics separately from musical space manifestations. That is, melody data 370 generated by the techniques disclosed herein can be rendered as music, such as through an electronic musical instrument or a speaker, without musical space 350 also being rendered. However, musical space 350 may be represented, such as on a display, and melody data 370 may be represented in the displayed musical space through graphical elements located at the rhythm and pitch coordinates corresponding to the pitch and rhythmic timing defined in the melody data 370.

Rhythm generation component 310 may be constructed or otherwise configured to establish rhythmic timing across melody data 370. Such may be achieved by producing a sequence of musical elements, i.e., notes and rests, whose respective durations and relative locations in the sequence establish, when the sequence is rendered in a human-perceivable form, a rhythm in a musical sense. In a machine, rhythm generation component 310 establishes a sequence of musical elements 375, each associating a note or rest attribute with a duration over which the attribute is active. The sequencing of musical elements 375 of melody data 370 may be achieved through multiple techniques, such as time-stamping and adhering to a temporal order when rendering the data in human-perceivable form. Sequencing may also be established through sequential linking of data, such as through a linked list or similar technique. The present invention is not limited to the manner in which the sequencing of musical elements 375 is preserved, so long as the technique is free to choose what musical element, be that element a note or rest, goes where in the sequence.

Pitch assignment component 330 may be constructed or otherwise configured to assign respective pitch values to pitch attributes of musical elements 375 sequenced by rhythm generation component 310. Such value may be an indicator (e.g., C, F #) of a particular pitch in a set of pitches, e.g., the pitches of a musical scale or of a chord.

For purposes of explanation, placement of a musical element 375 of melody data 370 will be described and illustrated herein as occurring in music space 350. "Up" and "down" movements in music space 350 correspond to an increase and a decrease in pitch, respectively, while "left" and "right" movements correspond to an increase and a decrease in the sequencing index (e.g., time), respectively. Musical elements 375 occurring to the left of other musical elements occur later in the sequence than those other musical events. This is familiar to a "piano roll" where the most recently played note emerges to the left of previously played notes. However, it is to be understood that the present invention is not limited to this configuration.

Each musical element 375 of melody data 370 may comprise a type attribute that identifies the musical element as a note or a rest, a duration attribute that identifies a number of rhythm units over which the note or rest is active and a pitch attribute that identifies the pitch of the note, should the musical element be a note. These attributes may be assigned specific values by rhythm generation component 310 in accordance with rhythm constraints selected by a user and by pitch assignment component 330 in accordance with pitch constraints selected by the user. Rhythm constraints may include rhythm constraints 320*a*-320*g*, representatively referred to herein as rhythm constraint(s) 320 and pitch constraints may include pitch constraints 340*a*-340*h*, representatively referred to herein as pitch constraint(s) 340. These exemplary constraints are described below.

A match constraint 320*a* regulates the number of notes of the output melody that match the notes of source data 305.

A note density constraint 320*b* regulates the number of notes generated in the output melody.

A rest density constraint 320*c* determines how many rests (with their respective durations) must be present in the output. For example, if the rest density is set to 4/measure, there must be 4 rests present in every measure on average.

A triplet constraint 320*d* regulates the presence/number of notes that conform to triplet timing. A triplet may be viewed as aligning on a triplet grid formed in musical space 350.

A guaranteed rest constraint 320*e* forces the output to create a rest/silence in a specific placement in musical space 350 as defined by, for example, X and Y coordinates of guaranteed rest curve/envelope. A curve/envelope control for asserting the guaranteed rest constraint in such a manner is described below. A control point on the curve being set to 100% guarantees that a rest will be created in a corresponding location in musical space. A control point setting of 0% guarantees that a rest will never be present in that location in musical space.

A guaranteed note constraint 320*f* forces the output to always generate a note in a specific placement in musical space as defined by the X and Y coordinates on a guaranteed note curve. If the Y axis of a curve control is used for probability from 0 to 100%, a maximum value of 100% will guarantee that a note must be present in musical space at the location indicated to by the curve. A minimum value of 0% will guarantee that a note will never be present in musical space at that location indicated to by the curve.

A note density delta constraint 320*g* determines how the note density changes over time. Note density delta constraint 320*g* may be applied through a curve/envelope control indicating which parts of the melody should have more notes and which parts have fewer notes. A maximum value on the curve will result in a densely-populated clump of notes clustered around the control point and a minimum value of 0 is equivalent to creating a "rest" in the notes with no notes generated in that space.

A follow scale/chords constraint 340*a* specifies whether melody generation should follow the key/scale selected by the user when generating pitches for the melody or chords that are presented in musical source data 305.

A starting pitch constraint 340*b* specifies where in musical space the melody generation process is to place the first note.

A shape constraint 340*c* instructs the technique which movements from note to note in musical space are allowed. In the case of random selection, movements up or down are equally probable. Shapes may be specified using different pitch stencils—where the most basic shapes are: going up, going down, up-down-up, down-up-down, or random.

A repetition constraint 340*d* limits the number of repetitions in note-repetition musical transitions. For example, consider the note-repetition feature C, C, C, C, C. If the repetition constraint control is set to a numeric value like "5", the maximum number of repeated C notes will be 5, after which a change in pitch is forced in the generated output.

A lane constraint 340*e* determines inclusion/exclusion of specific pitches from consideration in pitch assignment. Applying the lane constraint is exemplified below.

A note-repetition constraint 340*f* determines what ratio or percentage of notes should maintain the same pitch as the previous note that was generated in the output melody.

A step constraint 340*g* determines what ratio or percentage of notes should maintain pitch that's one step away (upwards or downwards) in the same scale. For example, if the original pitch was C, the step constraint would establish what percentage of notes need to advance to pitch "D" (one above C), or pitch "B" (one below B).

A leap constraint 340*h* determines which ratio or percentage of notes should maintain pitch that is two steps away or more (upwards or downwards) in the same scale, from the original pitch. For example, if the original pitch was C, the minimum leap possible is either to "A" (going down from C>skipping B>going to A), or to "E" (going up from C>skipping D>going to E). The optional setting of a control that sets the minimum, average, or maximum size of the leap that's allowed to occur during melody generation.

Key/Scale constraint 360*a* specifies what pitch values are defined on the pitch axis of musical space 350.

Output length constraint 360*b* specifies a desired length of the output melody.

Absent enforcement of the foregoing constraints, selection of musical elements 375*a* of melody data 370 may occur randomly according to a uniform distribution. However, embodiments of the invention allow coloring of such selection through user-selectable statistical distributions, e.g., rhythm distributions 307 and pitch distributions 303. Rhythm distributions 307 and pitch distributions 303 may reflect statistics of various songs, artists, musical styles, musical genres, etc., essentially without limit. Embodiments of the present invention may implement libraries of such statistical distributions from which a selection can be made by the user. Rhythm distributions 307 may specify percentages of notes that occur on-beat vs. off-beat, and other rhythm-based parameters. Pitch distributions 303 may specify percentages of different pitches that are contained in the sample space (the songs, artists, etc.). Specific distributions may be selected by the user through a suitable control, such as a dropdown control. Examples of utilizing different rhythm distributions and pitch distributions are discussed below.

Figure 4:
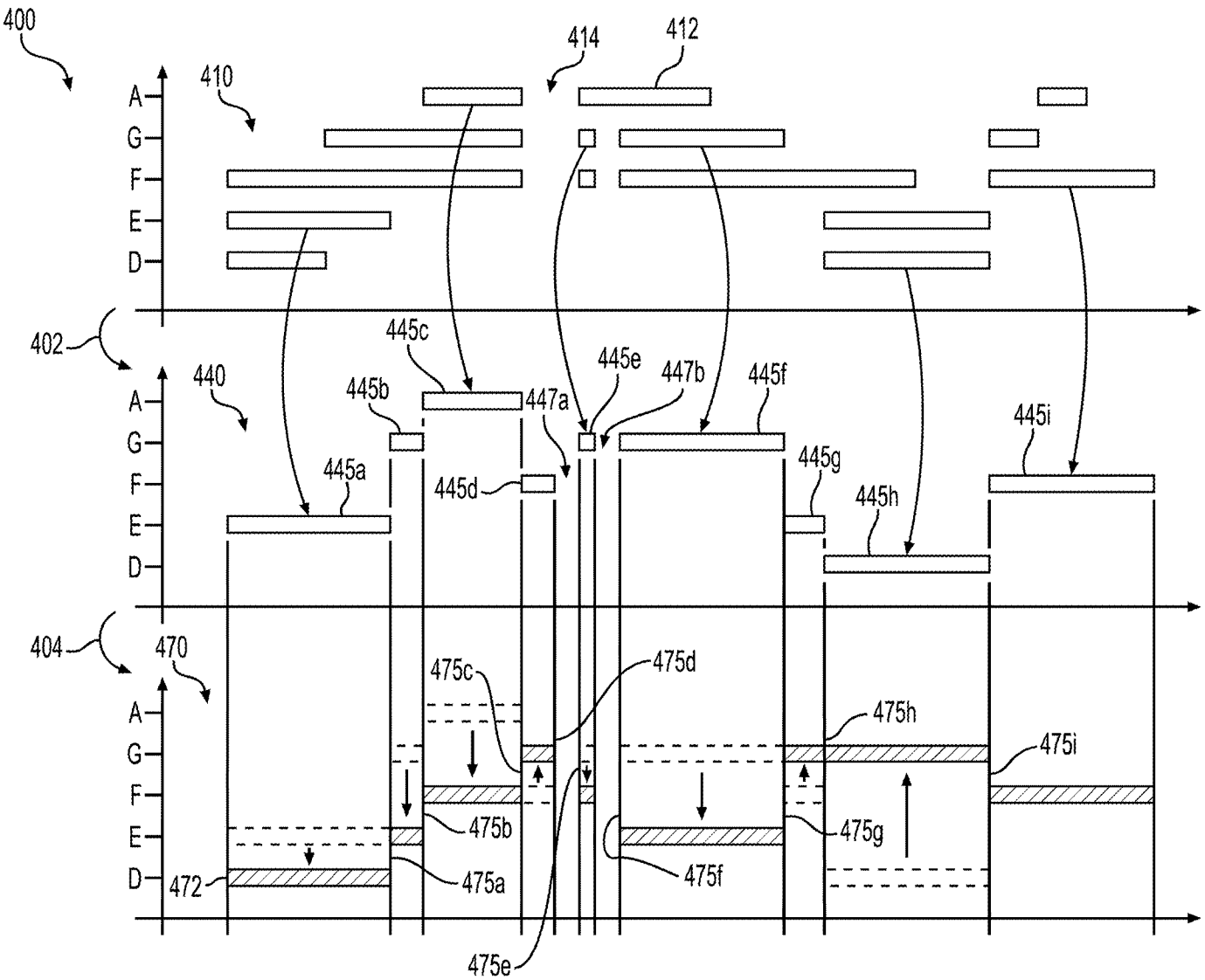
FIG. 4 is a conceptual diagram depicting certain fundamental melody generation operations of which the present invention can be embodied.

FIG. 4 is a conceptual diagram depicting certain fundamental melody generation operations 400 of which the present invention can be embodied. For purposes of description and not limitation, melody generation operations 400 of FIG. 4 are said to occur in two stages: a rhythm extraction stage 402, which may be realized by rhythm generation component 310, and a pitch assignment stage 404, which may be realized by pitch assignment component 330. Rhythm extraction stage 402 operates on musical data 410, which in this case, is displayed using a piano roll metaphor of a musical space defined by rhythm (time sequencing) and pitch. The input musical data 410 comprises notes, such as note 412, and rests, such as rest 414. Notes 412 can be represented in a machine by data structures that associate a specific pitch with a specific duration. Rests, too, can be implemented in data structures associating silence with the duration of that silence.

As demonstrated by musical data 410, music generally may comprise complex features beyond notes and rests, e.g., chords. Such complex features may be represented in a machine by data structures that contain references to the notes comprising the feature. The transition from one set of notes to another set of notes, or from a set of notes to silence, is sensed in humans as a musical event and it is the timing of such musical events that gives rise to the perception of rhythm. By way of embodiments of the invention, musical events in an accompaniment piece (atop which the melody resides), some of which may be very subtle, are extracted in a particular way to arrive at interesting rhythmic timings for the target melody.

Rhythm generation stage 402 seeks to produce a set of musical elements that establish rhythm for the melody. Typically, the rhythm of the melody will tie in to the accompaniment piece, e.g., that represented in musical data 410, and embodiments of the invention implement an optional match constraint that specifies the number or percentage of notes in the output melody that are copied from the accompaniment piece. It is to be understood that such copying includes copying the note duration and its timing, where copying the note's pitch is less important at rhythm generation stage 402, since the melody's ultimate pitch structure is determined in pitch assignment stage 404. As illustrated in FIG. 4, notes 445*a*, 445*c*, 445*e*, 445*f*, 445*h* and 445*i* of rhythm notes data 440 are copied from musical data 410, which corresponds to a match constraint of 67% for an output melody length of nine (9) notes. The selection of which note gets copied can be determined by probabilistic weighting, where the composer may select or otherwise establish a note distribution that favors the selection of certain notes over the selection of others. The composer may select a uniform note distribution, in which case probability of any note being selected is equal to the probability of any other note being selected.

Other constraints may be enforced in rhythm generation stage 402. A primary constraint is that the melody has only one note playing at a time. Another primary constraint is that a rest and a note cannot coincide in musical space. Another primary constraint is that there must be a note or a rest at every location in the melody over its length specified by the composer.

Note 445*d* may be inserted into rhythm note data 440 according to a guaranteed note constraint. Rest 447*a* may be inserted into rhythm note data 440 according to a guaranteed rest constraint. Guaranteed notes and guaranteed rests may be located in musical space through a control that specifies their timing relative to other notes and rests in rhythm note data 440.

Notes 445*b* and 445*g* may be inserted into rhythm note data 440 to meet a note density constraint and rest 447*b* may be inserted into rhythm note data 440 to meet a rest density constraint.

With all rhythm constraints met, notes 445*a*-445*i* and rests 447*a*-447*b* combine to define a rhythm for the melody that is based on the rhythm of the accompaniment piece yet has some features of its own based on the composer's preferences. Consider, for example, that note 445*d* is played during the silence of rest 414 in musical data 410. Such note (and rest) placement in the melody adds musical depth to the overall musical piece.

In certain embodiments, notes and rests are positioned within the length of the melody on a grid and a probability distribution of a particular musical element being positioned at a particular grid position. Certain implementations utilize space fitting operations to ensure that the musical elements fit within the desired length of the melody. The probability distribution according to which the musical elements are placed may be selected by the composer. For every possible grid position of where a note or rest may appear, there is a corresponding probability of it appearing in that position. The probability distribution may be detailed. For example, there may be 256 possible grid positions covered by the probability distribution, and that number can be increased if desired. The composer may opt for different probability distributions that define different musical styles, such as Reggae, House, etc.

Pitch assignment stage 404 seeks to modify the pitch of notes 445*a*-445*i* in accordance with pitch constraints specified by the composer without affecting the musical element timing established during rhythm generation stage 402. Pitch constraints applied during pitch assignment stage 404 result in melody data 470 comprising a plurality of musical transitions 475*a*-475*i* that depend on musical transitions occurring temporally earlier in the melodic sequence.

A starting pitch constraint may be applied that specifies the pitch on which the melody is to begin. Accordingly, in the example illustrated, note 445*a* is adjusted down in pitch to meet the starting pitch constraint, as illustrated at starting pitch 472. Once starting pitch 472 has been established, other pitch constraints may be applied to establish musical transitions between the notes and rests positioned during rhythm generation stage 402. For example, note 445*b* may be adjusted downward in pitch so that musical transition 475*a* forms a step relative to note 445*a* to meet a step constraint. Note 445*c* may be adjusted down in pitch to avoid an excluded lane, specified by a lane constraint, while simultaneously forming another step at musical transition 475*b*. Note 445*d* may be adjusted upwards in pitch and note

445*e* may be adjusted downwards in pitch to meet an "up-down-up" pattern constraint. Note 445*f* may be adjusted downward in pitch and note 445*g* may be adjusted upward in pitch to form a leap at musical transition 475*g* to meet a leap constraint. Note 445*h* may be adjusted upwards to form a note-repetition at musical transition 475*h* to meet a note-repetition constraint. Note 445*i* may remain at its originally assigned pitch and thereby forming a downward step at musical transition 475*i*.

Figure 5:
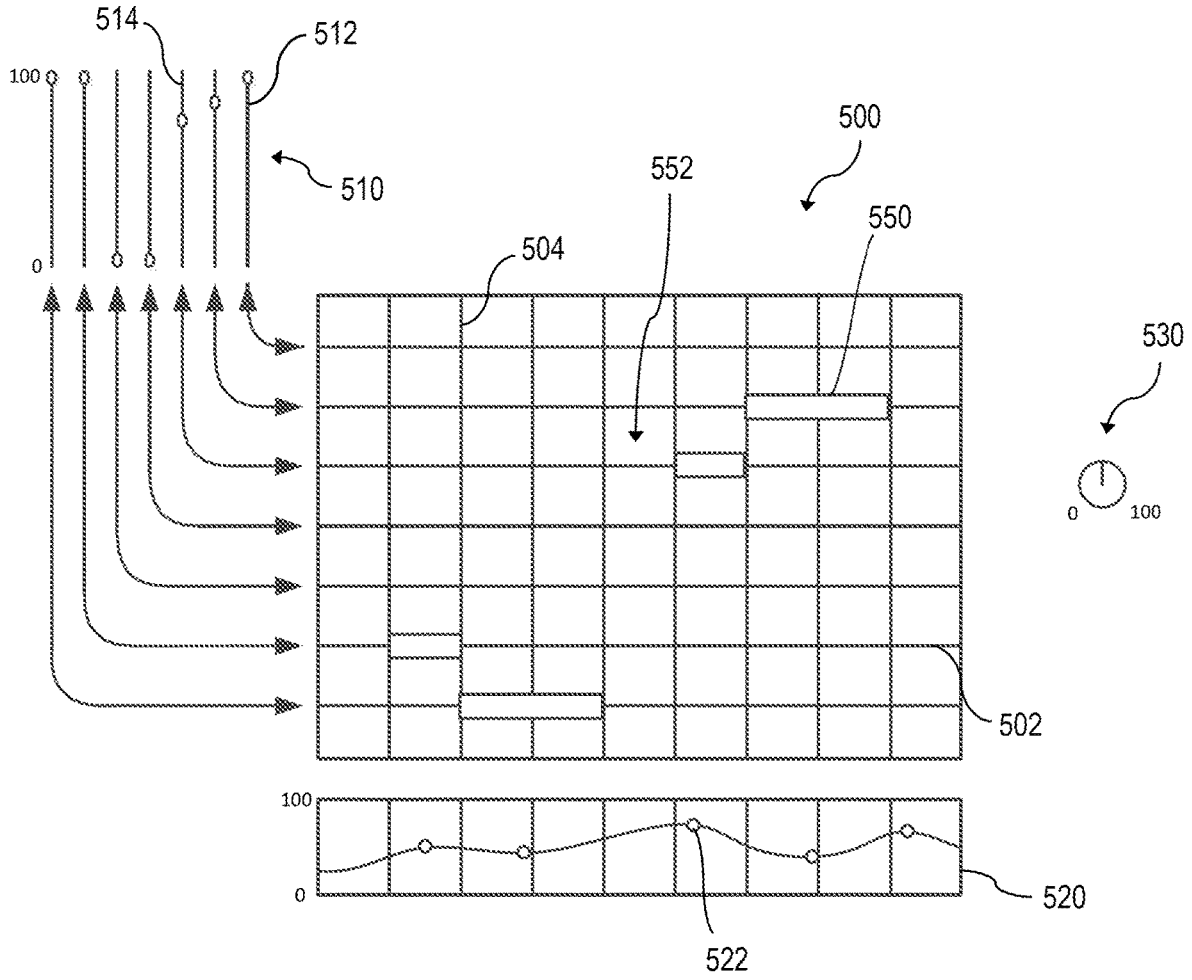
FIG. 5 is a diagram depicting exemplary mechanisms by which constraints may be specified by a user in accordance with embodiments of the invention.

FIG. 5 is a diagram depicting exemplary mechanisms by which constraints may be specified by a user in accordance with embodiments of the invention. In the illustrated example, a musical space 500 is gridded by horizontal grid lines 502 demarcating pitch and vertical grid lines 504 demarcating rhythm. Musical elements including notes, such as note 550, and rests, such as rest 552, are positioned in musical space 500 on the grid formed thereon according to the specified constraints.

Many constraints may be specified by a knob 530 or similar control (such as a slider control) that can be actuated between 0 and 100 percent of its full range of travel. Such control allows the composer to select a desired percentage from 0 to 100 and to assign the selected percentage to a target parameter or constraint. The selected percentage may be applied to a number, such as to indicate a certain percentage of notes, or may assign a probability, where 0% signifies a desire to exclude a musical event (e.g., placement of a musical element at a particular position in musical space 500) and 100% signifies a desire to ensure or guarantee the occurrence of a musical event.

As discussed above, certain constraints are applied according to characteristics of a curve/envelope, which may be shaped by a composer using a curve/envelope control 520. The ordinate (Y-coordinate) of the curve indicates a percentage (0%-100%) of the target features being placed in musical space 500 at a location corresponding to the abscissa (X-coordinate) of the curve. Alternatively, the ordinate of the curve may indicate a probability that a subject musical event occurs at the location corresponding to the abscissa. Curve/envelope control 520 may include control points 522 that can be actuated by a user to establish the shape of the curve.

For example, an optional match curve/envelope may be implemented that determines how many notes should match the notes of the source data. If the curve control point is set to 100%, the rhythm of the note from the source data will be copied into the current melody output. At points on the curve that are set to 0, a guarantee that the notes won't match is asserted.

Embodiments of the invention may implement a lane control 510 by which constraints can be specified on a pitch-by-pitch basis. To that end, lane control 510 may have a plurality of controls, such as slider controls 514, each representing a different lane on which a particular constraint is being applied. In certain cases, lane control 510 specifies a probability distribution of pitches that can exclude certain pitches from being selected. For example, when all lanes are at 100%, i.e., slider 512 is positioned at 100% across all lanes, it is equally probable for a next musical event in a melodic sequence to occur on any lane (be that lane specifying a pitch of a chord or a pitch of a certain key). That probability can be diminished on any lane by positioning the slider 512 of the corresponding slider control 514 to indicate the desired probability between 0% and 100%. When a particular slider control 514 of lane control 510 is positioned at the 0% location, note placement in the corresponding lane (pitch) of musical space 500 is excluded.

Figure 6:
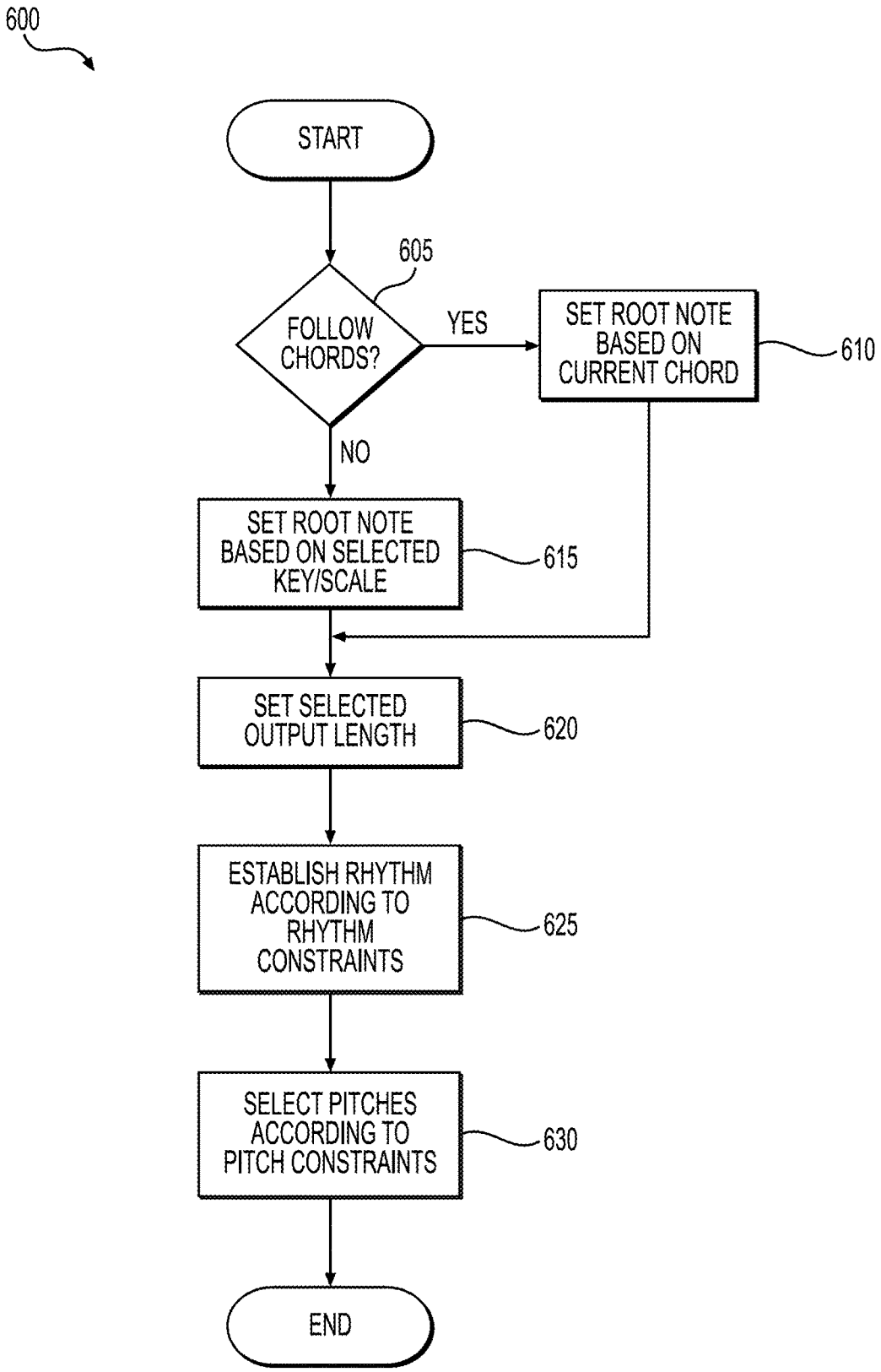
FIG. 6 is a flow diagram of an example melody generation process by which the present invention can be embodied.

FIG. 6 is a flow diagram of an example melody generation process 600 by which the present invention can be embodied. In operation 605, it is determined whether the follow chords constraint is active. Embodiments of the invention include a control that allows the user to select between a follow scale mode and a follow chords mode. In the follow scale mode, the pitch of the output melody is related to the key/scale chosen by the user. The "2nd" note of the scale would be the same throughout the composition regardless of any harmonic or melodic changes in the input or output. In the follow chords mode, each time there is a chord change in the optionally-connected input, the "root note" is calculated as the "root note of the chord from the input". For example, if the input source data contains a C-major chord, the root note for the follow chords mode would be the C note. If the input then presents a D-minor chord, the root note of the D Minor chord would be the D note.

If the follow chords constraint is active, process 600 transitions to operation 610, whereby the root note of the pitch axis in musical space is set to correspond with a current chord for which a note in the melody is being selected. When the chord changes to that having a different root note, the root note is set to that of the new chord. Lane assignments are also affected by the follow chord constraint.

If, in operation 605, it is determined that the follow chords constraint is not active, meaning that the follow scale constraint is active, process 600 may transition to operation 615, whereby the root note is set according to the selected key/scale. A user may select the key/scale in which the melody is composed. In the absence of this information, this combination can be chosen at random, or based on some other factors where user input is not required, such as knowing the root key and scale of the acapella/vocal used for the composition.

In operation 620, the user-selected output length of the melody data is set. As explained above, the length of the output can be user configured through the output length constraint, but could be indefinitely long as well—it is the user's choice whether to let the technique choose the desired output, or limit the length to a specific number of measures, beats or seconds.

In operation 625, process 600 establishes rhythm of the melody in accordance with user-selected rhythm constraints and in operation 630, pitches of the melody are selected according to user-selected pitch constraints.

Figure 7:
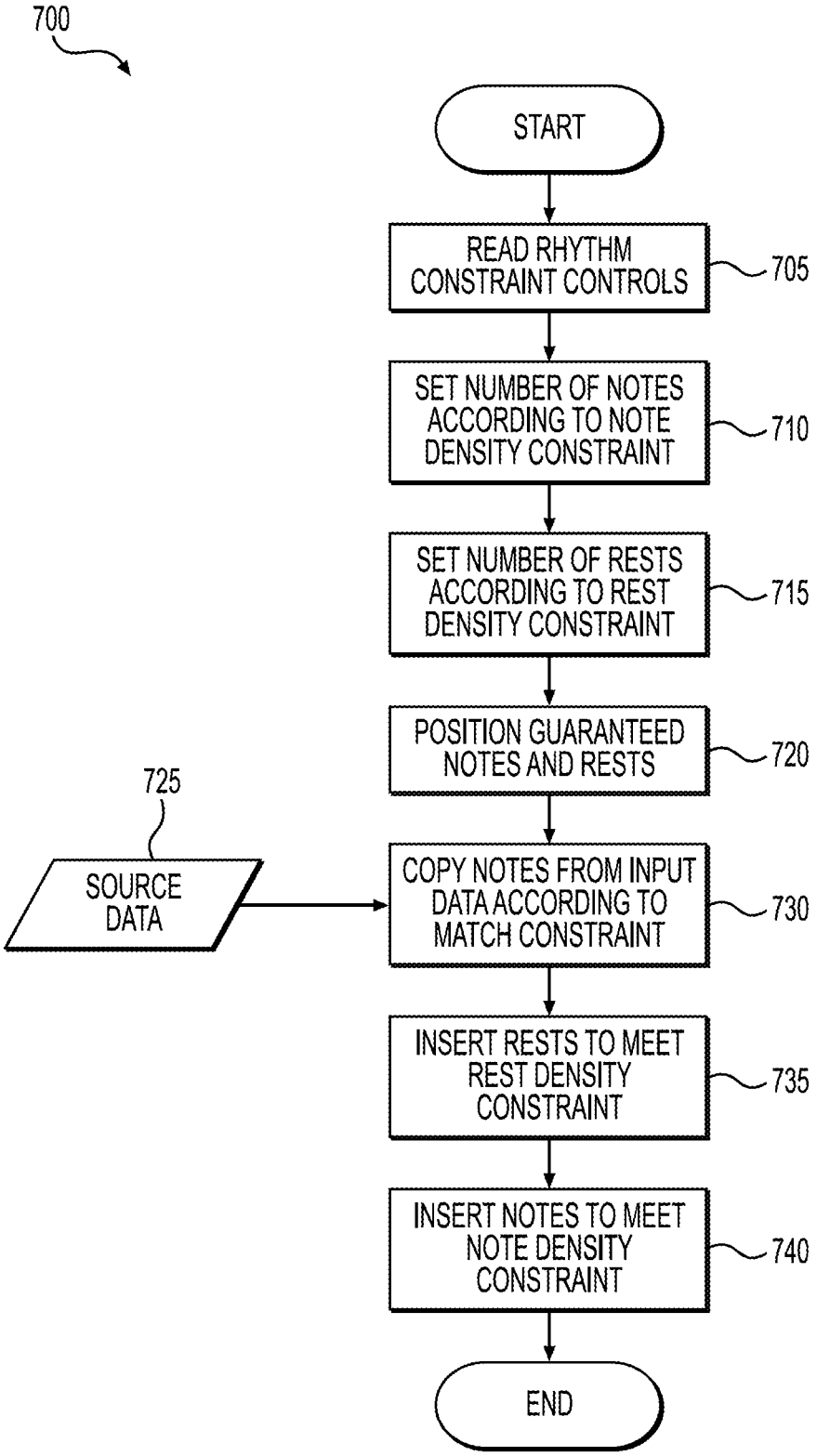
FIG. 7 is a flow diagram of an example rhythm generation process by which the present invention can be embodied.

FIG. 7 is a flow diagram of an example rhythm generation process 700 by which the present invention can be embodied. In operation 705, rhythm constraint controls are read to ascertain the user's preferences on rhythmic content. In operation 710, the number of notes is set according the note density constraint and the output length constraint and, in operation 715, the number of rests is set according to the rest density constraint. For example, if the note density constraint is set to 10 notes, then there must be 10 notes created in the output per each measure. If the match constraint is set to 50%, it means that 5 of those 10 notes must be identically-timed as their input counterparts. It would be equivalent to choosing 5 notes at random in the input, and copying them to the output.

In operation 720, guaranteed notes and rests are positioned in musical space, that is, specific pitch and rhythm coordinates are assigned to musical elements representing the notes and rests of the melody. For example, if using a guaranteed note curve with a value set to 100%, the result must appear in the output regardless of whether it occurred as part of the match probability randomization described below; hence the "guaranteed" name since it bypasses randomization. Similarly, if using the guaranteed rest curve, some rests must be created regardless of whether they happened randomly due to weighted randomization.

In operation 730, notes are copied from source data 725 based upon the match constraint. The technique can take input from other sources as a guideline for the match approach. An example of this input is MIDI notes from another channel, such as a chords channel, a bass channel, or another channel containing MIDI data that can be used to extract a rhythm. In the absence of MIDI data, the same type of extraction can be performed on an audio signal to detect rhythm, transients, or pitch and generate the input to be passed into other steps in this technique.

The match constraint may be set to a value ranging from 0 to 100%, where 0% means that the output note can never have the same rhythm as the input note. A value of 100% acts as a copy/paste from input to output, because it means that the note must always be the same. For example, if the match constraint is set to 50%, 50% of notes from the input must be copied to the output. If set to 75%, then 75% of notes must be copied from input to output, and so on. In certain embodiments, the match control may be implemented by a button that establishes either 100% match probability or 0% match probability.

Notes may be randomly picked from the input to copy to the output. However, as indicated above, it is possible that notes are not chosen at random, but instead based on a statistical distribution of where the notes are more likely or less likely to be copied from. For example, the statistical distribution, which may be embodied as a histogram, can indicate that notes located on the beats of the song are more likely to get copied, while the notes on the off-beats may be less likely to be copied. The histogram can be pre-generated ahead of time based on popular songs or genres known to musicians. This histogram can be a set of probabilities showing the distribution of notes across a given time unit, such as one measure, 4 measures, 16 measures or more, using a coarse or fine quantization grid. For example, a histogram may contain start positions using a 1/64th resolution which provides very fine detail about where notes are expected to start, and the probability of the starting point located at the 1/64th position, at the 2/64th position, at the 3/64th position, and so on. In one embodiment, the histogram may contain thousands of those position points along with their corresponding probabilities of note occurrence at that position.

Rest placement can be based on statistical distributions as well, where the statistical distributions (histograms) contain different presets of probabilities where rests can occur. When creating rests in the output, the technique may pick a rest at random based on its probability of occurrence. The rest is defined as the start of a silence, and the duration of a silence. Since rests prevent notes from being positioned at the same location in musical space, it is implied that rest creation must happen before notes are added to the output, so newly created notes do not get overridden by the rests created afterwards. For example, if the note density constraint is set to 10, and the rest density constraint is set to 2, the total output must have 10 visible notes and 2 silences in the given output space. In an alternative embodiment, the rests could be added after notes are positioned, potentially resulting in 8 visible notes, 2 notes that were deleted by rests, and 2 rests in the output In one embodiment, the rest histogram distribution and the rest guarantee curve can be combined into one control that "guarantees" the result if the value is set high, to 100%, and guarantees a lack of rest if the value is set low, to 0%. Everything in between will randomly set the rest based on weighted probability. This simplification of user interaction can be desirable so the blending of two techniques doesn't have to happen as a result of having two separate controls.

In operation 735, rests are inserted into the melodic sequence to meet the rest density constraint. The onset timing (where in the sequence the rest occurs) and duration of each inserted rest may be determined according to rest onset timing and duration statistical distributions selected by the composer.

In operation 740, notes are inserted into the melodic sequence to meet the note density constraint. The onset timing (where in the sequence the note occurs), pitch and duration of each inserted note may be determined according to rest onset timing and histogram of note distributions selected by the composer. The insertion of rests and notes is also constrained by general rules: that notes and rests cannot coincide and that from its beginning to its end, a melody comprises a sequence of musical elements, where a musical element is assigned a mutually exclusive rest or note attribute, a duration that can be determined using space fitting techniques and statistical distributions. Notes may be assigned pitch attributes based on pitch distributions selected by the composer.

In the event that note density is changed using curve control points, the technique may use weighted random techniques or similar methods to distribute notes with different densities across the output melody.

More exotic note placements may be introduced into the rhythm using the optional triplets constraint that changes the placement of regular notes, to a more irregular, or triplet pattern. This can create a sense of anticipation that's commonly used in trap music. Increasing the triplet constraint converts a higher percentage of notes to those irregular triplet starting points. All other parameters of rhythm generation are still respected, but instead of quantizing to a regular 4/4 grid, for example, the notes may be quantized to a specific triplet grid for a certain percentage of the time, as indicated by the triplet constraint value.

The rhythm can be created independently of any pitch changes. Rhythm generation, based solely on the optional match with input data, combined with rest histogram distribution with random weighting, and note density to determine the total number of visible notes in the output, will result in pleasant and interesting rhythms. Due to research conducted by the inventor, it was discovered that the overlap of some chords rhythm and some melody rhythm results in a more musical composition, such as the one possible to obtain by copying about 50% of the rhythm used in the chords to the new rhythm of the melody.

Figure 8:
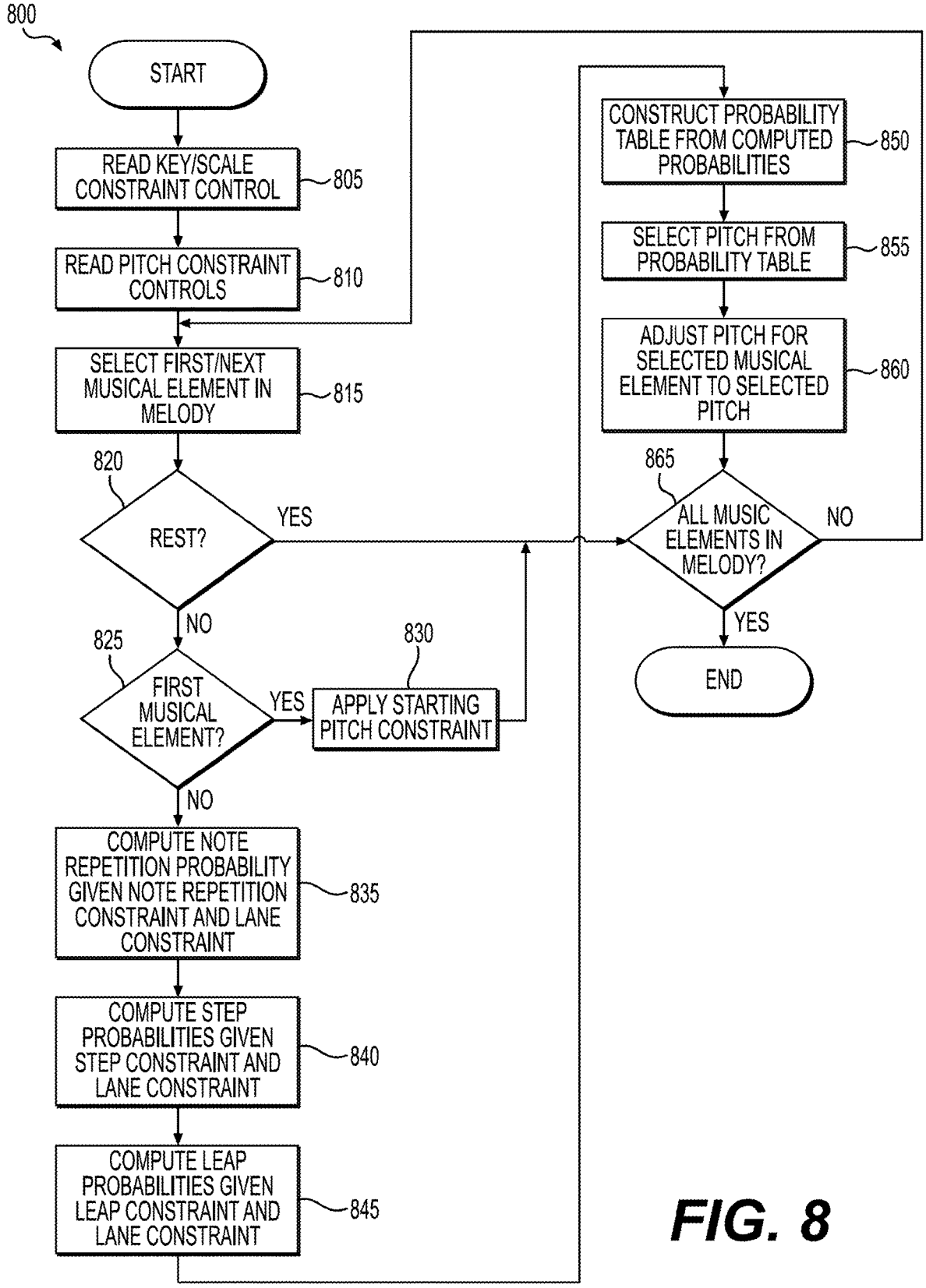
FIG. 8 is a flow diagram of an example pitch assignment process by which the present invention can be embodied.

FIG. 8 is a flow diagram of an example pitch assignment process 800 by which the present invention can be embodied. In operation 805, the key/scale constraint control is read to define the set of pitches from which the melody is composed. This can be viewed as establishing the pitch axis of a musical space, where the rhythm axis of the musical space is established during rhythm generation process 700.

In operation 810, pitch constraint controls are read to establish the composer's preference over the pitch content of the melody. In operation 815, the first musical element in the melodic sequence established by rhythm generation process 700 is selected for processing. In operation 820, it is determined whether the currently selected musical element is a rest. If so, pitch assignment process 800 may transition to operation 865, whereby it is determined whether the currently selected musical element is the final musical element in the melodic sequence and, if so, process 800 terminates. If it is determined in operation 820 that the currently selected musical element is not a rest, meaning that it is a note, then process 800 may transition to operation 825, whereby it is determined whether the currently selected musical element is first in the sequence. If so, process 800 may transition to operation 830 whereby a starting pitch constraint is applied, i.e., the pitch attribute of the currently selected musical element is assigned a value equal to the selected starting pitch, which may otherwise be selected according to starting pitch statistics for the key/scale and musical type, genre, style, motif.

Embodiments of the invention implement a set of seven controls that determine the pitch used for the first note of the melody. This set of controls includes "Root", "2nd", "3rd", "4th", "5th", "6th", "7th" lanes. The control may be a button, or a checkbox to indicate which one (or more) of the controls is selected. If the "root" position is selected, it guarantees that the first note must be located in musical space at that root pitch position. Depending on whether the follow scale or follow chord mode is selected, the first note will adjust to the chosen value for either scale or chord, depending on the selection. For example, if the scale is C-major, and the starting point is set to "2nd", the first note in the output must be adjusted to be a D note, because the D note is the second note of the C Major scale.

Each minor or major key/scale combination typically contains seven lanes, and the lanes are different for each key/scale combination. Embodiments of the invention include a set of seven controls that determine the probability of notes playing in that lane for the currently chosen key and scale combination. The controls may be implemented as sliders or knobs, each with a value such as 0 to 100, that allow each control to be set individually, with the goal of specifying the proportion of each value in relation to other values. For example, if the value for knobs 1, 2 and 3 are set to 100%, and all the other knobs at set at zero, it implies that the output melody must use the lanes 1, 2 and 3 only. In another embodiment, this invention may have a checkbox instead of knobs/sliders, where the only allowed values are 0 and 100% ("off" and "on"), if more granular control is not desired. In another embodiment, the distribution of starting points may be shown as a dropdown box, or another type of control to select a pre-made combination of starting points, such as root+6, or root 80%+6th 20%.

Embodiments of the invention include a number of controls, e.g., step, leap and an optional note-repetition, to determine the shape of the pitch output. The constraint controls refer to the relationship between the currently-examined note, and the note that came before it. In a note-repetition relationship, the pitch used by the current and the previous notes are the same, such as C Note>C Note. In a step relationship, the relationship is adjacent. The notes are close to each other, but are not the same note. It can be illustrated as "B note>C note", or "D note>C note". In both cases, the note is just one "step" away from the previous note inside the given key and scale. It is important to note that step relationships apply to specific key/scale combinations only. The C note>D note relationship may not be valid in some scales where there is another valid note present in between them, such as a D-flat note. The step relationship may be calculated only when throwing away "invalid" pitches that don't belong to the chosen key and scale. The leap relationship refers to situations where the distance of the step is larger than 1, for example, from C note to F note. The controls may control the ratio of how often the note-repetition musical transition is desired, how often the step musical transition is desired and how often the leap musical transition is desired. Optionally, there may be a control that sets the maximum, average, and minimum amount of leap that should be applied of the leap behavior is triggered by weighted random probability. This could prevent situations where the leap distance is too high, such as leaping 10 notes instead of a desired maximum of 5 notes. In another embodiment, default values for desired leap size, maximum or minimum leap size may be set by default without user intervention.

In operation 835, a note-repetition probability is computed based on the note-repetition value and lane constraints. As explained above, the setting of the note-repetition constraint control and the setting of the lane constraint control that corresponds with the same pitch as assigned to the previous musical element may be multiplied together. For example, if the current note is a C note, the note-repetition constraint control is set to 40%, and the "Root Note" lane is set to 50%, the probability is calculated as 40%*50%=20% calculated probability.

In operation 840, step probabilities are computed in a similar way; the setting of the step constraint control and the setting of the lane controls corresponding to the pitches that are a step away from the pitch assigned to the previous musical element may be multiplied together. For example, if the current note is a C note, the two possible step lanes are B and D. If the B lane contains 100% probability, and the D lane contains 25% probability, and the step control is set to 50%, the probability of a B outcome becomes 100%*50%=50% probability for B lane. The probability for the D lane becomes 25%*50%=12.5% probability for D lane.

In operation 845, leap probabilities are computed based on the leap and lane constraints. The setting of the leap constraint control and the setting of the lane controls that are various leap distances away from the pitch assigned to the previous musical element may be multiplied together. For example, if the leap control is set to 10%, and the F lane has a 10% probability, the resulting probability for a leap to the "F" lane would be 10%*10%=1%.

In operation 850, a probability table may be constructed with the computed probabilities. In operation 855, a pitch is selected from the weighted distribution of pitch probabilities carried in the probability table. In operation 860, the pitch for the currently selected musical element is adjusted or reassigned to equal the pitch selected from the probability table. In operation 865, it is determined whether all musical elements in the melody have been processed and, if not, process 800 may transition to operation 815, whereby the next musical element in the melody is selected for processing.

In the event that the note could be placed in a higher or lower octave with the same pitch, for example, a low C note, or a high C note, the technique may optionally choose the octave that is closer to the previous note in pitch, to prevent a huge one octave leap from occurring inadvertently. This behavior is referred to as "minimize leap."

In an alternative embodiment, a separate control for note repetition can be omitted. When so embodied, any note not covered by step and leap constraints or subsequent to all step and leap constraints being met, the system can assign that note to be the same as the previous note, i.e., a note repetition.

The present invention allows independent creation of rhythm and pitch, and the combination of the two based on this inventive technique. The rhythm output sounds musical, because it borrows elements from the input channel and allows some of those elements to be re-used in the output, resulting in a more rhythmically harmonious composition. The pitch sounds musical because it allows the musician to specify which "lanes" to use for stylistic purposes, since every lane sounds different, and can result in vastly different moods inside the musical composition. The ability to control note-repetition, step and leap behavior results in melodies that look like a combination of note-repetition, repetitive parts with staircases of notes rising and falling, to create drama and tension.

In one embodiment, the rhythm may have a separate repetition control that specifies how often the rhythm should be copy/pasted to repeat the same theme, such as "short note-short note-long note". Repetition is desirable, and this invention can allow the creation of repetition by limiting the number of notes in the rhythm that play without repeating.

In another embodiment, the template for repetition may be defined by the user, such as: Repeat Measure 1 inside Measure 3, and Repeat Measure 2 inside Measure 4. This type of preset can help with creating predictable but pleasant melodies that repeat certain motifs over time. This type of preset can be applied independently to rhythm generation, and to pitch adjustment, resulting in output that may have repeated rhythm but completely unique pitch, or repeated pitch but with a unique rhythm. Both examples are desirable.

In another embodiment, the pitch may be affected by the user specified shape constraint, such as "Up" or "Down". If the "Up" shape is chosen, the melody of the pitch must be ascending until it reaches a break or end-of-shape indication. For example, a melody like B>C>D is an ascending melody. If the shape constraint is set to Up, the melody output will be allowed to go up in pitch based on the notes step probability. If note-repetition behavior is chosen at random based on the weighted probabilities, the melody may look like this: B>B>C>C>D. The present invention covers this possibility and encourages the creation of melodies that "generally" go up, even if that upward motion does not occur with each step. An optional shape length constraint control may determine how long to continue creating the up shape until the staircase ends, and the shape restarts with building a new staircase starting with the bottom step, creating a second staircase.

In certain embodiments, lane constraints may be overridden by shape constraints. Optionally, there may be a control that overrides the values set by the lanes constraints that will guarantee a shape value like "Up" to be created, even if the lane constraint excludes such upward movement.

In another embodiment, the previously described "Shape=Up" constraint setting can be used to create basslines that follow the chords. For example, if the lane constraint is set to Root and 5, and the chords are changing throughout the input of the song, setting the note-repetition constraint to 0%, setting the step constraint to 0%, and setting the leap constraint to 100%, then the technique will automatically jump from the root note to the 5th position, and back again, with every note of the output melody. If the follow chords constraint is active, the output melody will jump to the Root and then the 5th note of each chord, resulting in a pleasant "disco bass" type of bassline that is formed by playing the Root and 5th of each chord. In the follow scale mode, the bassline would always play the C and G note indefinitely, since those are the Root and 5th lane of the C Major scale. However, if the follow chords constraint is active, embodiments of the invention will create a bassline that plays C and G notes during the C-major chord in the input, the D and A notes during the D-minor chord in the input, and so on. Each new chord will force a recalculation of the Root and 5th Lane, resulting in a bass that follows the chords.

In another embodiment, the shape constraint may have a more complex distribution of movements up and down. For example, the probability of going up may be 90% and the chance of going down may be 10%, for a more varied output that combines movements in both directions.

In another embodiment, the rhythm generation and the pitch generation may optionally be performed independently of each other. For example, the pitch generation part of this invention may be applied to notes already created previously. Alternatively, the rhythm for notes may be changed while keeping the same pitch structure.

Figure 9:
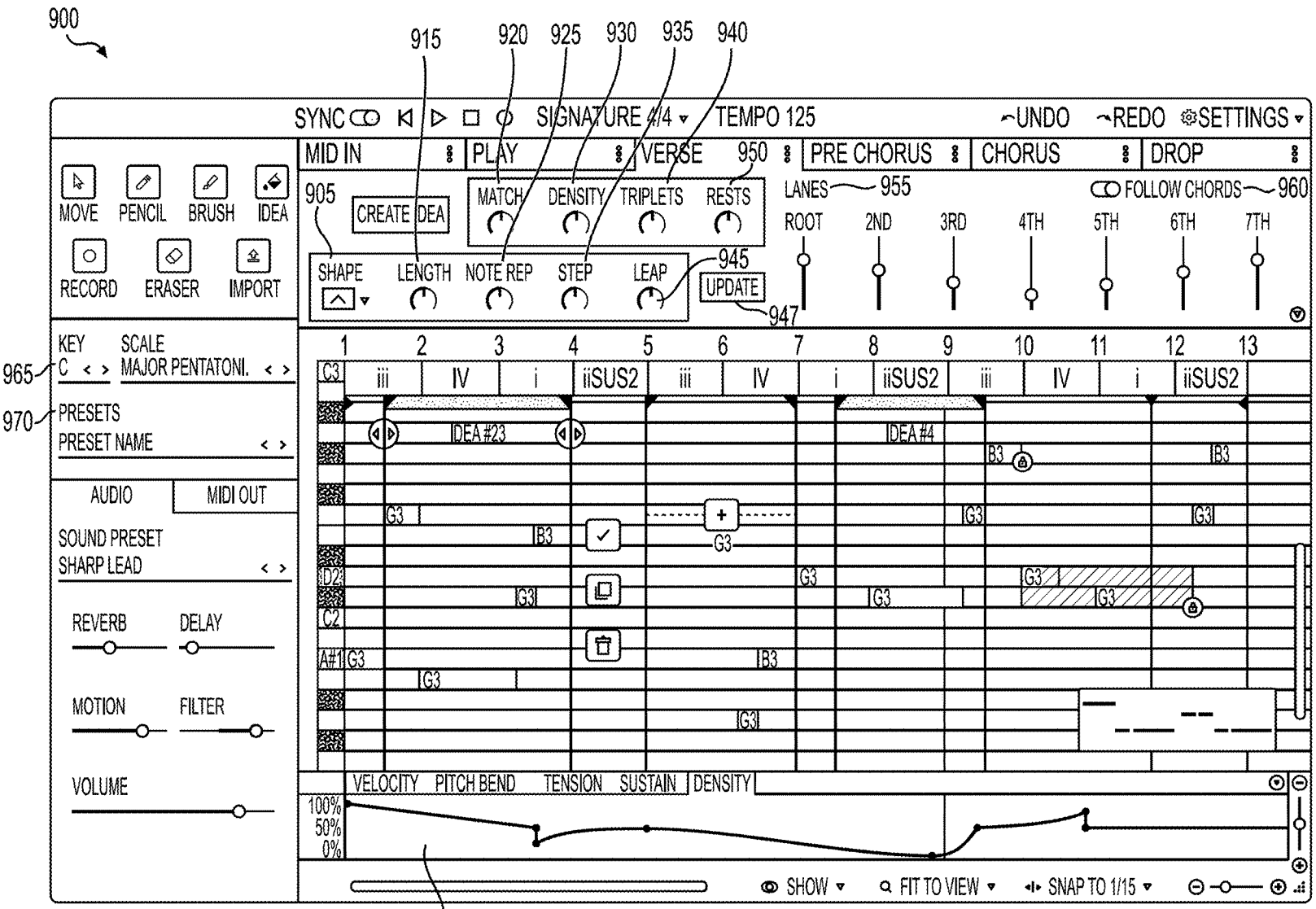
FIG. 9 is a diagram of an example interface with which the present invention can be embodied.

FIG. 9 is a diagram of an example interface 900 with which the present invention can be embodied. Interface 900 may be realized using graphical user interface techniques to afford control over the melody generation components and processes described herein.

A shape constraint control 905 may be configured to assert the composer's preferences on melodic shapes as described above. A length constraint control 915 may be configured to assert the composer's preferences on the output length constraint. A match constraint control 920 may be configured to assert the composer's preferences on the match constraint. A note-repetition constraint control 925 may be configured to assert the composer's preferences on the note-repetition constraint. A density constraint control 930 may be configured to assert the composer's preferences on the note density constraint. A step control 935 may be configured to assert the composer's preferences on the step constraint. A triplets control 940 may be configured to assert the composer's preferences on the triplets constraint. A leap control 945 may be configured to assert the composer's preferences on the leap constraint. A rest control 950 may be configured to assert the composer's preferences on the rest constraint. A lanes control 955 may be configured to assert the composer's preferences on the lane constraint. A follow chords control 960 may be configured to assert the composer's preferences on the follow chords/scale constraint. A key/scale control 965 may be configured to assert the composer's preferences on the key/scale constraint. A preset control 970 may be configured to select pitch and rhythm statistical distributions. A curve/envelope control 975 may be configured to assert the composer's preferences on the guaranteed note and rest constraints, the match constraint and the note density delta constraint.

Certain embodiments of the invention may include an update control 947 that automatically sets the constraint controls based on the input data or the composition as written. Upon activation of update control 947, the system may analyze the composition on the canvas, be that the input data or the composer's own work, and determine what constraints are met by that composition. The system may then set the constraint controls accordingly. For example, if 50% of the rhythm corresponds with the rhythm of the input data, then the system will automatically set the match control to 50%. Other controls may be similarly set based on the analysis. Additionally, the analysis may indicate styles or artists whose compositions are similar to the user's composition. The composer may then activate update control 947 to establish constraints that match the indicated style or artist.

The storage areas and memory, such as memory 132, may be implemented by any quantity of any type of memory circuit or storage device, and may be volatile (e.g., RAM, cache, flash, etc.), or non-volatile (e.g., ROM, hard-disk, optical storage, etc.), and include any suitable storage capacity.

Processor 134 is, for example, one or more data processing devices such as microprocessors, microcontrollers, systems on a chip (SOCs), or other fixed or programmable logic, that executes instructions for process logic stored in memory. The processors may themselves be multi-processors, and have multiple CPUs, multiple cores, multiple dies comprising multiple processors, etc.

I/O interface 136 enables communication between a display device, input device(s), and output device(s), and the other components and may enable communication with these devices in any suitable fashion, e.g., via a wired or wireless connection. The display device (not illustrated) may be any suitable display, screen or monitor capable of displaying information to a user 5, for example the screen of a tablet or the monitor attached to a computer workstation. Input device(s) (not illustrated) may include any suitable input device, for example, a keyboard, mouse, trackpad, touch input tablet, touch screen, camera, microphone, remote control, speech synthesizer, or the like. Output device(s) (not illustrated) may include any suitable output device, for example, a speaker, headphone, sound output port, or the like.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable medium may be, for example, but is not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a solid state disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, a phase change memory storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, e.g., an object oriented programming language such as Java, Smalltalk, C++ or the like, or another procedural programming language, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The computer systems of the present invention embodiments may alternatively be implemented by any type of hardware and/or other processing circuitry. The various functions of the computer systems may be distributed in any manner among any quantity of software modules or units, processing or computer systems and/or circuitry, where the computer or processing systems may be disposed locally or remotely of each other and communicate via any suitable communications medium (e.g., LAN, WAN, Intranet, Internet, hardwire, modem connection, wireless, etc.).

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

A processing system suitable for storing and/or executing program code may be implemented by any computer or processing systems equipped with a display or monitor, a base (e.g., including the processor, memories and/or internal or external communications devices (e.g., modem, network cards, etc.) and optional input devices (e.g., a keyboard, mouse or other input device)). The system can include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the system to become coupled to other processing systems or remote printers or storage devices through intervening private or public networks. Modems, cable modem and Ethernet cards are just a few of the currently available types of network adapters.

The block diagrams in the figures illustrate the architecture, functionality, and operation of possible implementations of systems, method and computer program products according to various embodiments of the present invention. In this regard, each block in the block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometime be executed in the reverse order, depending on the functionality involved. It will also be noted that each block of the block diagrams, and combinations of blocks in the block diagrams, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Embodiments of the invention include the following.

A method comprising: accepting one or more machine-readable constraints from a user through a user interface, the constraints including rhythm constraints and pitch constraints; generating a sequence of musical elements based on the constraints, each of the musical elements specifying, in machine-readable data, a musical pitch or silence and a duration of the musical pitch or silence, the pitch constraints prescribing pitches in the sequence of musical elements and the rhythm constraints prescribing rhythm of the sequence of musical elements; and rendering the sequence of musical elements in human-perceivable form.

The method above, further comprising: assigning a note or rest attribute to each of the musical elements to meet the rhythm constraints, the note attribute indicating that the musical element specifies the musical pitch and the rest attribute indicating that the musical element specifies the silence; and assigning a pitch to each of the musical elements having the note attribute assigned thereto to meet the pitch constraints.

The method above, further comprising: assigning a pitch value to a musical element in the sequence of musical elements based on the pitch constraints; and selecting another pitch value for a musical element next in the sequence of musical elements to the musical element assigned the pitch value, the other pitch value being selected from a probability distribution of candidate pitch values determined from the pitch constraints.

The method above, further comprising: constructing the probability distribution of candidate pitch values by, for each candidate pitch value, multiplying a pitch constraint determinant of inclusion of the candidate pitch value with a pitch constraint on a distance in pitch between the pitch value assigned to the musical element and that assigned to the candidate pitch value.

The method above, wherein the candidate pitch values are determined from chords of the data file or from a selected key depending on a follow chords constraint.

The method above, wherein the pitch constraints on inclusion of the candidate pitch value include a lane constraint by which the candidate pitch value is assigned a probability of selection.

The method above, wherein the pitch constraints on the distance in pitch includes a note-repetition constraint for which the distance between the candidate pitch value and the pitch value assigned to the musical element is zero.

The method above, wherein the pitch constraint on the distance in pitch includes a step constraint for which the distance between the candidate pitch value and the pitch value assigned to the musical element is one.

The method above, wherein the pitch constraint on the distance in pitch includes a leap constraint for which the distance between the candidate pitch value and the pitch value assigned to the musical element is greater than one.

The method above, wherein accepting one or more machine-readable constraints from a user through a user interface including accepting a selection of a probability distribution for the rhythm constraints and the pitch constraints The method above, further comprising: analyzing the generated sequence of musical elements against known musical styles or artists; and configuring the constraints to generate other musical elements that correspond to the musical styles or artists.

An apparatus comprising: a processor configured to: accept one or more machine-readable constraints from a user through a user interface, the constraints including rhythm constraints and pitch constraints; generate a sequence of musical elements based on the constraints, each of the musical elements specifying, in machine-readable data, a musical pitch or silence and a duration of the musical pitch or silence, the pitch constraints prescribing pitches in the sequence of musical elements and the rhythm constraints prescribing rhythm of the sequence of musical elements; and render the sequence of musical elements in human-perceivable form.

The apparatus above, wherein the processor is further configured to: assign a note or rest attribute to each of the musical elements to meet the rhythm constraints, the note attribute indicating that the musical element specifies the musical pitch and the rest attribute indicating that the musical element specifies the silence; and assign a pitch to each of the musical elements having the note attribute assigned thereto to meet the pitch constraints.

The apparatus above, wherein the processor is further configured to: assign a pitch value to a musical element in the sequence of musical elements based on the pitch constraints; and select another pitch value for a musical element next in the sequence of musical elements to the musical element assigned the pitch value, the other pitch value being selected from a probability distribution of candidate pitch values determined from the pitch constraints.

A computer readable medium having encoded thereon processor instructions that, when executed by a processor, causes the processor to: accept one or more machine-readable constraints from a user through a user interface, the constraints including rhythm constraints and pitch constraints; generate a sequence of musical elements based on the constraints, each of the musical elements specifying, in machine-readable data, a musical pitch or silence and a duration of the musical pitch or silence, the pitch constraints prescribing pitches in the sequence of musical elements and the rhythm constraints prescribing rhythm of the sequence of musical elements; and render the sequence of musical elements in human-perceivable form.

The computer readable medium above, further comprising processor instructions that cause the processor to: assign a note or rest attribute to each of the musical elements to meet the rhythm constraints, the note attribute indicating that the musical element specifies the musical pitch and the rest attribute indicating that the musical element specifies the silence; and assign a pitch to each of the musical elements having the note attribute assigned thereto to meet the pitch constraints.

The computer readable medium above, further comprising processor instructions that cause the processor to: assign a pitch value to a musical element in the sequence of musical elements based on the pitch constraints; and select another pitch value for a musical element next in the sequence of musical elements to the musical element assigned the pitch value, the other pitch value being selected from a probability distribution of candidate pitch values determined from the pitch constraints.

The computer readable medium above, further comprising processor instructions that cause the processor to: construct the probability distribution of candidate pitch values by, for each candidate pitch value, multiplying a pitch constraint determinant of inclusion of the candidate pitch value with a pitch constraint on a distance in pitch between the pitch value assigned to the musical element and that assigned to the candidate pitch value.

The computer readable medium above, further comprising processor instructions that cause the processor to: accept a selection of a probability distribution for the rhythm constraints and the pitch constraints.

The computer readable medium above, further comprising processor instructions that cause the processor to: analyze the generated sequence of musical elements against known musical styles or artists; and configure the constraints to generate other musical elements that correspond to the musical styles or artists.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

The invention claimed is:

1. A method comprising:

receiving machine-readable constraints, the machine-readable constraints including a rhythm constraint and a pitch constraint;

generating a sequence of musical elements based on the machine-readable constraints, each of the musical elements specifying a musical pitch or silence and a duration of the musical pitch or silence, the pitch constraint prescribing a pitch in the sequence of musical elements and the rhythm constraint prescribing a rhythm of the sequence of musical elements;

rendering the sequence of musical elements in human-perceivable form; and assigning a pitch value to a musical element in the sequence of musical elements based on a probability distribution of candidate pitch values determined from the pitch constraint.

2. The method of claim 1, further comprising:

after rendering the sequence of musical elements in the human-perceivable form, inserting a rest attribute in the sequence of the musical elements to meet the rhythm constraint, the rest attribute indicating that a musical element specifies the silence.

3. The method of claim 1, further comprising:

after rendering the sequence of musical elements in the human-perceivable form, inserting a note attribute in the sequence of musical elements to meet the rhythm constraint, the note attribute indicating that a musical element specifies the musical pitch.

4. The method of claim 1, wherein the candidate pitch values are determined from chords of a data file or from a selected key depending on a follow chords constraint.

5. The method of claim 1, wherein the probability distribution of candidate pitch values is determined based on a pitch constraint determinant of inclusion of a candidate pitch value and a pitch constraint on a distance in pitch between another pitch value assigned to the musical element and that assigned to the candidate pitch value.

6. The method of claim 5, wherein the pitch constraint determinant of inclusion of the candidate pitch value includes a lane constraint by which the candidate pitch value is assigned a probability of selection.

7. The method of claim 5, wherein the pitch constraint on the distance in pitch includes a note-repetition constraint for which the distance between the candidate pitch value and the another pitch value assigned to the musical element is zero.

8. The method of claim 5, wherein the pitch constraint on the distance in pitch includes a step constraint for which the distance between the candidate pitch value and the another pitch value assigned to the musical element is one.

9. The method of claim 5, wherein the pitch constraint on the distance in pitch includes a leap constraint for which the distance between the candidate pitch value and the another pitch value assigned to the musical element is greater than one.

10. A non-transitory computer-readable medium including computer executable instructions, wherein the instructions, when executed by a computer, cause the computer to perform a method, the method comprising:

receiving machine-readable constraints, the machine-readable constraints including a rhythm constraint and a pitch constraint;

generating a sequence of musical elements based on the machine-readable constraints, each of the musical elements specifying a musical pitch or silence and a duration of the musical pitch or silence, the pitch constraint prescribing a pitch in the sequence of musical elements and the rhythm constraint prescribing a rhythm of the sequence of musical elements;

rendering the sequence of musical elements in human-perceivable form; and assigning a pitch value to a musical element in the sequence of musical elements based on a probability distribution of candidate pitch values determined from the pitch constraint.

11. The non-transitory computer-readable medium of claim 10, further comprising:

after rendering the sequence of musical elements in the human-perceivable form, inserting a rest attribute in the sequence of the musical elements to meet the rhythm constraint, the rest attribute indicating that a musical element specifies the silence.

12. The non-transitory computer-readable medium of claim 10, further comprising:

after rendering the sequence of musical elements in the human-perceivable form, inserting a note attribute in the sequence of musical elements to meet the rhythm constraint, the note attribute indicating that a musical element specifies the musical pitch.

13. The non-transitory computer-readable medium of claim 10, wherein the candidate pitch values are determined from chords of a data file or from a selected key depending on a follow chords constraint.

14. The non-transitory computer-readable medium of claim 10, wherein the probability distribution of candidate pitch values is determined based on a pitch constraint determinant of inclusion of a candidate pitch value and a pitch constraint on a distance in pitch between another pitch value assigned to the musical element and that assigned to the candidate pitch value.

15. The non-transitory computer-readable medium of claim 14, wherein the pitch constraint of inclusion of the candidate pitch value includes a lane constraint by which the candidate pitch value is assigned a probability of selection.

16. The non-transitory computer-readable medium of claim 14, wherein the pitch constraint on the distance in pitch includes a note-repetition constraint for which the distance between the candidate pitch value and the another pitch value assigned to the musical element is zero.

17. The non-transitory computer-readable medium of claim 14, wherein the pitch constraint on the distance in pitch includes a step constraint for which the distance between the candidate pitch value and the another pitch value assigned to the musical element is one.

18. The non-transitory computer-readable medium of claim 14, wherein the pitch constraint on the distance in pitch includes a leap constraint for Which the distance between the candidate pitch value and the another pitch value assigned to the musical element is greater than one.

19. The non-transitory computer-readable medium of claim 10, further comprising:

analyzing the generated sequence of musical elements against known musical styles or artists; and configuring the machine-readable constraints to generate other musical elements that correspond to the musical styles or artists.

20. An apparatus comprising:

a processor configured to:

receive machine-readable constraints, the machine-readable constraints including a rhythm constraint and a pitch constraint, generate a sequence of musical elements leased on the machine-readable constraints, each of the musical elements specifying a musical pitch or silence and a duration of the musical pitch or silence, the pitch constraint prescribing a pitch in the sequence of musical elements and the rhythm constraint prescribing a rhythm of the sequence of musical elements, render the sequence of musical elements in human-perceivable form, and assign a pitch value to a musical element in the sequence of musical elements based on a probability distribution of candidate pitch values determined from the pitch constraint.

* * * * *